US008746674B2

(12) United States Patent
Herden et al.

(10) Patent No.: US 8,746,674 B2
(45) Date of Patent: Jun. 10, 2014

(54) NON-INTEGER OVERLAP FEEDER FOR MACHINES PROCESSING PRINTING MATERIALS

(75) Inventors: Matthias Herden, Mannheim (DE); Bernhard Wagensommer, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 11/800,498

(22) Filed: May 4, 2007

(65) Prior Publication Data

US 2007/0262517 A1 Nov. 15, 2007

(30) Foreign Application Priority Data

May 4, 2006 (DE) ..... 10 2006 020 714

(51) Int. Cl.
*B65H 5/08* (2006.01)

(52) U.S. Cl.
USPC ..... 271/12; 271/11; 271/90; 271/107

(58) Field of Classification Search
USPC ..... 271/10.01, 10.02, 10.03, 11, 12, 97, 98, 271/90, 107, 114, 115, 166
See application file for complete search history.

(56) References Cited

U.S. PATENT DOCUMENTS

| | | | | |
|---|---|---|---|---|
| 4,227,685 | A * | 10/1980 | Fischer | 271/13 |
| 4,494,745 | A * | 1/1985 | Ward et al. | 271/95 |
| 4,632,381 | A * | 12/1986 | Cuir et al. | 271/270 |
| 4,651,984 | A * | 3/1987 | Emrich | 271/237 |
| 4,863,154 | A | 9/1989 | Hirakawa et al. | |
| 4,867,433 | A * | 9/1989 | Wells et al. | 271/35 |
| 5,074,539 | A * | 12/1991 | Wells et al. | 271/12 |
| 5,213,036 | A | 5/1993 | Tokuno et al. | |
| 5,219,157 | A * | 6/1993 | Takahashi | 271/114 |
| 5,228,674 | A * | 7/1993 | Holmes | 271/11 |
| 5,595,381 | A * | 1/1997 | Schickedanz | 271/12 |
| 5,613,675 | A | 3/1997 | Krüger et al. | |
| 5,870,957 | A * | 2/1999 | Muller | 101/484 |
| 6,182,959 | B1 * | 2/2001 | Eitel et al. | 271/3.22 |
| 6,364,311 | B1 * | 4/2002 | Merz et al. | 271/248 |
| 7,717,420 | B2 * | 5/2010 | Bechtler et al. | 271/203 |

FOREIGN PATENT DOCUMENTS

| | | | |
|---|---|---|---|
| DE | 1 189 919 | | 3/1965 |
| DE | 44 44 755 | A1 | 8/1995 |
| DE | 691 12 615 | T2 | 5/1996 |
| DE | 196 11 561 | A1 | 9/1997 |
| DE | 100 44 068 | A1 | 4/2001 |
| EP | 0 644 139 | A1 | 3/1995 |
| EP | 1 528 021 | A1 | 5/2005 |
| JP | 7215541 | A | 8/1995 |
| JP | 2003341878 | A | 12/2003 |

* cited by examiner

*Primary Examiner* — Ernesto Saurez
(74) *Attorney, Agent, or Firm* — Laurence A. Greenberg; Werner H. Stemer; Ralph E. Locher

(57) ABSTRACT

A sheet transport apparatus in a sheet processing machine has at least one driven transport belt for the transport of sheet printing materials from a first location to a second location. It being possible for the transport belt to be driven at different transport speeds. The acceptance of the sheet printing materials at the first location is carried out at a relatively low transport speed, and the transfer of the sheet printing materials at the second location is carried out at a relatively high transport speed.

7 Claims, 2 Drawing Sheets

NON-INTEGER OVERLAP FEEDER FOR MACHINES PROCESSING PRINTING MATERIALS

CROSS-REFERENCE TO RELATED APPLICATION

This application claims the priority, under 35 U.S.C. §119, of German application DE 10 2006 020 714.9, filed May 4, 2006; the prior application is herewith incorporated by reference in its entirety.

BACKGROUND OF THE INVENTION

Field of the Invention

The present invention relates to a sheet transport apparatus in a sheet processing machine, having at least one driven transport belt for the transport of sheet printing materials from a first location to a second location. It being possible for the transport belt to be driven at different transport speeds.

Sheet transport apparatus are used, inter alia, to supply sheetfed rotary printing presses and machines for further print processing with sheet printing materials, which are removed from a feed stack. The sheet transport apparatus in this case constitutes the connecting link between a sheet processing machine and a suction transport apparatus, which removes individual sheets from the feed stack and then passes them onto the sheet transport apparatus, which in turn transfers the sheet printing materials to the first printing unit of a sheetfed printing press, for example. The sheet transport apparatus in this case normally contains a conveyor belt or one or more suction belts, which supply the sheet printing materials removed from the feed stack to the printing press. The sheet transport apparatus can in this case be driven either by a drive of the printing press or a device for further print processing but there can also be a separate drive, which either drives only the sheet transport apparatus or the sheet transport apparatus together with the feeder.

A sheet feed unit having a sheet transport apparatus mentioned at the beginning is disclosed by European patent EP 0 644 139 B1, corresponding to U.S. Pat. No. 5,595,381. In this case, the sheet feed unit has a suction head, which removes sheets individually from a feed stack and supplies them to a sheet transport apparatus implemented as a belt table. The suction head and belt table can be driven in a manner coordinated with each other; in addition the speed of the belt table can be regulated in order to be able to control the transfer of the sheet from the suction belt table to the printing press disposed downstream. To this end, the belt table is able to execute sinusoidal movements. In this case, the sinusoidal movement is configured in such a way that the sheet printing materials have the lowest conveying speed both during the transfer from the suction head to the belt table and during the transfer from the belt table to the printing press. As a result, in particular during the transfer of the sheets from the belt table to the printing press, the sheets are prevented from slipping during the transfer to the printing press. However, such a sheet feed unit is suitable only for printing presses in which the sheet is transferred from the suction belt unit to the first printing unit as far as possible at a standstill.

A further sheet transport apparatus for conveying sheets in the feed region is disclosed by published, non-prosecuted German patent application DE 44 44 755 A1, corresponding to U.S. Pat. No. 5,613,675. In this case, the transport belt has its own motor, which can be controlled via speed profiles, the speed profiles preferably being configured in such a way that the conveying speed of the transport belt is at a minimum when a sheet is located in the region of the front stops on the conveyor table before the first printing unit. The sheets on the conveyor belt table in each case have an integer number. The speed profiles depend inter alia on the nature of the printing materials processed. This apparatus also has the disadvantage that, during the transfer from the conveyor belt to the first printing unit of the printing press, the sheet must come to a standstill in order to permit a precise transfer to the first printing unit.

SUMMARY OF THE INVENTION

It is accordingly an object of the invention to provide a non-integer overlap feeder for machines processing printing materials which overcome the above-mentioned disadvantages of the prior art devices of this general type, which permits a transfer of sheet printing materials from the sheet transport apparatus to a sheet processing machine arranged downstream without the sheet printing material having to come to a standstill.

With the foregoing and other objects in view there is provided, in accordance with the invention, a sheet transport apparatus in a sheet processing machine. The sheet transport apparatus contains at least one driven transport belt for a transport of sheet printing materials from a first location to a second location. The driven transport belt being driven at different transport speeds. An acceptance of the sheet printing materials at the first location being carried out at a relatively low transport speed, and a transfer of the sheet printing materials at the second location being carried out at a relatively high transport speed in comparison to the relatively low transport speed.

The sheet transport apparatus has a driven transport belt which transports the sheet printing materials from a first location to a second location. Furthermore, the transport belt can be driven at different transport speeds. According to the present invention, the acceptance of the sheet printing materials at the first location is carried out at a relatively low transport speed, and the transfer of the sheet printing materials at the second location is carried out at a relatively high transport speed. Therefore the sheet printing materials are accepted from the transport belt virtually or actually at a standstill while, at the end of the transport belt at a second location, a transfer to a following unit processing printing materials is carried out at a high transport speed. Since the transport belt circulates continuously, it is therefore necessary for acceptance and transfer of the sheet printing materials to be decoupled appropriately in time, which results in that when an acceptance of sheet printing materials at the start of the transport belt is being carried out at the first location, a transfer of sheet printing materials at the second location at the end of the transport belt must not be carried out at the same time. Therefore, according to the invention, the transport belt must be controlled in such a way that sheet acceptance and sheet transfer are decoupled from each other in time.

In a first refinement of the invention, provision is made for the sheet transport apparatus to be disposed between a feeder and the first printing unit of a printing press. In this case, the sheet transport apparatus accepts the separated sheets from the feed stack virtually or at a complete standstill and transfers the sheets to the first printing unit of a printing press at a high transport speed. Modern printing presses operate at a printing speed of more than 18,000 sheets per hour, which leads to a correspondingly high rotational speed of transport and printing cylinders in the printing press. During the transfer of sheets from the sheet transport apparatus to the first printing unit of the printing press, it is therefore necessary for the sheets to be accelerated to the rotational speed of the printing press. According to the present invention, this is done in that the transport of the transport belt of the sheet transport apparatus at the transfer time of the sheets to the first printing unit is carried out at a relatively high transport speed. It is thus possible to transfer the sheets to the first printing unit at a transport speed which already at least virtually corresponds to the processing speed of the printing press, so that the sheets in the first printing unit still have to be accelerated to the printing speed of the printing press only a little or even not at all.

Provision is advantageously made for the sheet transport apparatus to have a separate drive motor. The separate drive motor permits appropriate control of the sheet transport speed, so that, at the different acceptance and transfer times of the sheets, the corresponding low or high transport speed can be set. In this case, the separate drive motor is preferably controlled via the machine control system of the printing press, the synchronization with the following first printing unit and the feeder being carried out via electronic synchronization, so that the separate drive motor is able to control the speed of the transport belt as a function of the printing speed of the printing press and of the speed of the feeder. Using such a separate drive motor, particularly flexible control of the transport speed of the suction feed belt is possible. Alternatively, however, provision can also be made for it to be possible for the transport belt of the sheet transport apparatus to be coupled via a clutch either to a drive of an apparatus preceding the sheet transport apparatus or to a drive of an apparatus following the sheet transport apparatus. In this case, during the operation of the transport belt, mechanical coupling either to the first printing unit of the printing press or to the drive of the feeder is achieved. Since the speed of the transport belt is low during the sheet acceptance and high during the sheet transfer, the mechanical synchronization of the transport belt must in each case be carried out alternatingly either with the first printing unit or with the feeder. Therefore the clutches have to be engaged and disengaged alternatingly during the operation of the transport belt in order to be able to bring the transport belt to the desired speed in each case. In order to reduce the wear, the clutches provided should in particular be vario mechanisms or wear-free magnetic clutches.

In a further refinement of the invention, provision is made for the sheet transport speed during the acceptance of the sheet printing materials at the first location to be equal to zero. In this case, the sheet will be transferred from the feeder to the transport belt at an absolute standstill, which permits particularly precise deposition of the sheet on the transport belt. Furthermore, provision is made for the sheet transport speed at the second location during the transfer of the sheet printing materials to correspond to the processing speed of a following apparatus. As already mentioned, in this way sheets can be transferred in the first printing unit of a printing press at the transport speed corresponding to the rotational speed of the first printing unit. As a result, a direct transfer from transport belt to the feed drum of the first printing unit is made possible, it being possible for the feed drum to rotate at the printing speed. The speeds of the feed drum in the first printing unit and transport belt thus coincide during the sheet transfer.

In a further advantageous refinement of the invention, provision is made for the number of sheet printing materials on the transport belt to be able to be selected by the speed of the transport belt. In particular if the sheet transport apparatus has a separate electric drive, the number of sheets on the transport belt can be selected by the speed profile of the transport belt being adapted appropriately by the drive control system of the separate motor. The speed profiles of the sheet transport apparatus are in this case configured sinusoidally, the acceptance of the sheets being carried out at a speed minimum of the sine curve, while the transfer of the sheets is carried out at a speed maximum of the sine curve. By the variable period of the sinusoidal speed profiles, in this way the number of sheets on the transport belt can be controlled flexibly. As a result of decoupling transfer and acceptance of the sheets in time, according to the invention there is a non-integer number of sheet printing materials on the sheet transport belt. This is important for the functioning of the decoupling of acceptance and transfer times of the sheets at the first and at the second location. Only in this way is acceptance of the sheet printing materials at an absolute or virtual standstill at the first location possible while, at the second location, transfer of the sheet printing materials directly to a feed drum in the first printing unit of a printing press at an appropriate rotational speed is possible.

Other features which are considered as characteristic for the invention are set forth in the appended claims.

Although the invention is illustrated and described herein as embodied in a non-integer overlap feeder for machines processing printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
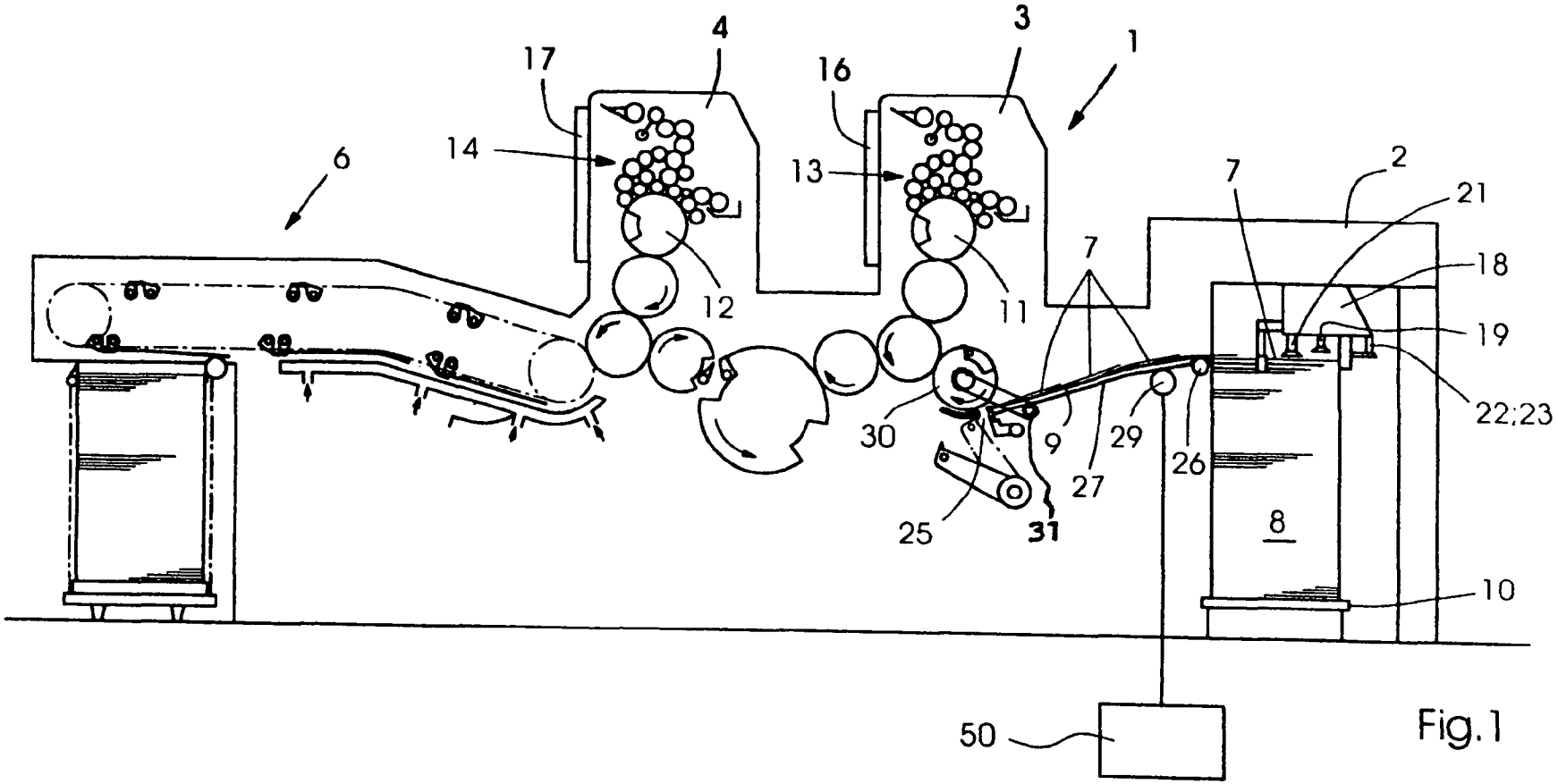
FIG. 1 is a diagrammatic, side sectional view of a sheetfed rotary printing press having two printing units and a sheet transport apparatus disposed between the first printing unit and feeder according to the invention.

Referring now to the figures of the drawing in detail and first, particularly, to FIG. 1 thereof, there is shown a sheetfed offset printing press 1 that has two printing units 3, 4 which are supplied with sheet printing materials 7 by a feeder 2. The second printing unit 4 is followed by a deliverer 6, which deposits the finally printed sheets 7 on a deliverer stack. The number of printing units 3, 4 is completely unimportant for the essence of the present invention and is therefore to be understood only by way of example. The two printing units 3, 4 of the printing press 1 in FIG. 1 each have an inking unit 13, 14 which supplies the plate cylinders 11, 12 with printing ink. On the plate cylinders 11, 12, there are the printing forms which, at a job change, can be removed by printing plate changers 16, 17 in order to be able to supply new printing plates. Furthermore, in the printing units 3, 4 there are blanket cylinders, which transfer the printing image from the plate cylinders 11, 12 to the sheets 7 in the press nip. Between the first printing unit 3 and the feeder 2 there is a feed table 9 which has a transport belt 27 according to the invention. The feed table 9 having the transport belt 27 accepts the sheets 7 from the feeder 2 and conveys them to a feed drum 30 in the first printing unit 3. In order to be able to control the transport belt 27 in accordance with the invention, the transport belt is driven by an electric drive motor 29, which can be synchronized electrically with the other drive motors, not shown here, of the printing press 1. The drive motor 29 and all the other drives and actuating devices of the printing press 1 are controlled centrally via a machine control system 50. The drive motor 29 is controlled in FIG. 1 in such a way that, during an acceptance 26 of the sheets 7 from the feeder 2, the speed of the transport belt 27 is very low or equal to zero. It can be seen that the sheets 7 on the transport belt 27 in FIG. 1 are conveyed in a series of overlaps. During a transfer 25 to the first printing unit 3, the sheets 7 must be accelerated to a rotational speed of the feed drum 30. Therefore, the transport speed of the transport belt 27 during a transfer 25 either corresponds exactly to the rotational speed of the feed drum 30 or deviates only little therefrom. The transfer 25 to the first printing unit 3 and the acceptance 26 of the sheets 7 from the feeder 2 is thus carried out in FIG. 1 at completely different transport speeds of the transport belt 27.

The sheets 7 transferred to the transport belt 27 during the acceptance 26 are at a standstill are first removed in the feeder 2 from a sheet stack 8 which rests on a stack support board 10. The stack support board 10 can be moved vertically, so that the upper edge of the stack 8 is always located largely at the same height. During operation, the upper edge of the stack 8 is registered by a sensing element 23, which ensures tracking of the stack supporting plate 8. The sheets 7 are removed from the stack 8 by a suction head 18, which lifts the sheets 7 by lifting suckers 19 and transports them in the direction of the sheet acceptance 26 by dragging suckers 21. The lifting suckers 19 and dragging suckers 21 are in this case additionally assisted by a blowing device 22. The feeder 2 in FIG. 1 can also have a separate drive motor, so that the printing units 3, 4, the transport belt 27 and the feeder 2 are synchronized with one another only electrically.

Figure 2:
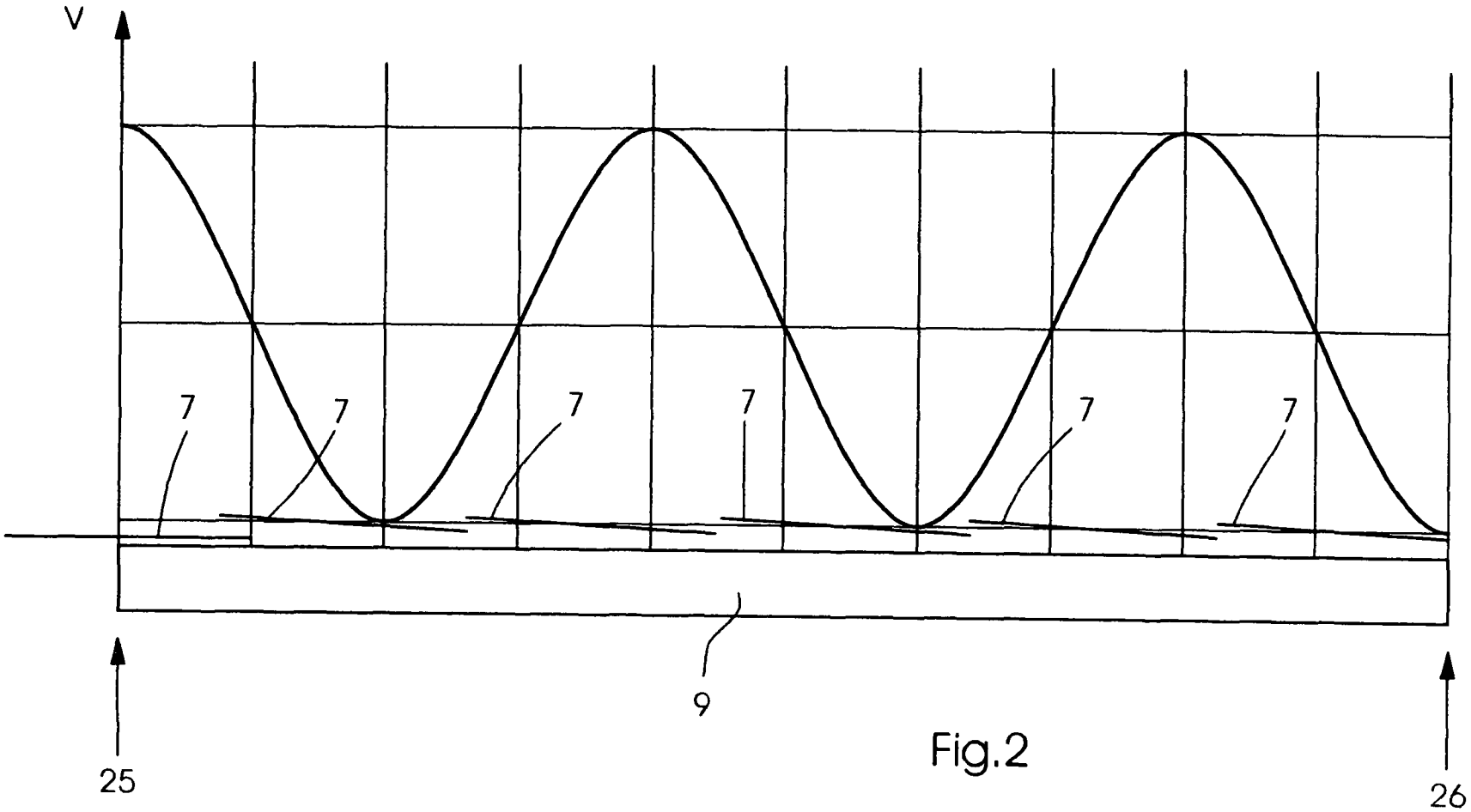
FIG. 2 is a graph showing a speed profile of the sheet transport apparatus plotted against a length of the sheet transport apparatus.

In FIG. 2, a speed distribution is plotted against the transport belt 27 of the feed table 9. It can be seen that, at the time of the acceptance 26 of the sheets 7 from the feeder 2, the transport belt 27 has no transport speed or only a very low transport speed. By contrast, at the time 25 of the transfer of the sheets from the transport belt 27 to the first printing unit 3, the transport belt 27 of the feed table 9 is operated at maximum transport speed, so that the sheets 7 can be transferred to the feed drum 30 at the same or at least approximately the same speed. It can be seen that, on account of the sinusoidal speed profile of the feed table 9, the number of sheets 7 which are transported in overlap form is not integer. In FIG. 2, by way of example, there are 5½ sheets 7 on the feed table 9. However, the number of sheets 7 can be set as configured by the machine control system 50 and the separate drive motor 29. For this purpose, it is merely necessary for the suitable speed profile having an appropriate number of speed minima and maxima over the feed table 9 to be selected. The speed profiles can either be stored in the machine control system 50 or, in the case of particularly flexible feed tables 9, they are calculated by the machine control system 50 during operation.

Alternatively, however, provision can also be made for it to be possible for the transport belt 27 of the sheet transport apparatus to be coupled via a clutch 31 either to a drive of an apparatus preceding the sheet transport apparatus or to a drive of an apparatus following the sheet transport apparatus.

We claim:

1. A sheet transport apparatus in a sheet processing machine being a printing press, the sheet transport apparatus being disposed between a feeder and a first printing unit of the sheet processing machine, the sheet transport apparatus comprising:

at least one driven transport belt for a transport of sheet printing materials from the feeder to the first printing unit, said driven transport belt configured for being driven at different transport speeds, an acceptance speed for acceptance of the sheet printing materials at the feeder being carried out at a relatively low transport speed that is substantially or actually a standstill, and a transfer speed for transfer of the sheet printing materials at the first printing unit being carried out at a relatively high transport speed in comparison to the relatively low transport speed, the transfer speed corresponding to a processing speed of the printing press; and a suction head for transporting the printing materials from the feeder toward a sheet acceptance of said transport belt, said suction head having lifting suckers for lifting the printing materials from a sheet stack in the feeder and dragging suckers for transporting the printing materials to said sheet acceptance.

2. The sheet transport apparatus according to claim 1, further comprising a separate drive motor for driving said driven transport belt.

3. The sheet transport apparatus according to claim 1, wherein said driven transport belt has a clutch and can be coupled via said clutch either to a drive of an apparatus preceding the sheet transport apparatus or to a drive of an apparatus following the sheet transport apparatus.

4. The sheet transport apparatus according to claim 1, wherein the transport of the sheet printing materials at the first printing unit during the transfer of the sheet printing materials to a following apparatus is carried out at a maximum speed of said driven transport belt.

5. The sheet transport apparatus according to claim 1, wherein at the first printing unit, the sheet printing materials are fed from said driven transport belt directly to a feed drum in the first printing unit.

6. A printing press, comprising:

a feeder;

a first printing unit;

a sheet transport apparatus having at least one driven transport belt for a transport of sheet printing materials from the feeder to the first printing unit, said driven transport belt configured for being driven at different transport speeds, an acceptance speed for acceptance of the sheet printing materials at the feeder being carried out at a relatively low transport speed that is substantially or actually a standstill, and a transfer speed for transfer of the sheet printing materials at the first printing unit being carried out at a relatively high transport speed in comparison to the relatively low transport speed, the transfer speed corresponding to a processing speed of the printing press; and a suction head for transporting the printing materials from said feeder toward a sheet acceptance of said transport belt, said suction head having lifting suckers for lifting the printing materials from a sheet stack in the feeder and dragging suckers for transporting the printing materials to said sheet acceptance.

7. The sheet transport apparatus according to claim 1, wherein said driven transport belt is configured to be driven with a sinusoidal speed profile, a minimum of said speed profile occurring at the acceptance of the sheet printing materials at the feeder, and a maximum of said speed profile occurring at the transfer of the sheet printing materials at the first printing unit.

* * * * *